US011839270B1

(12) United States Patent
Besbelli

(10) Patent No.: US 11,839,270 B1
(45) Date of Patent: Dec. 12, 2023

(54) RING AND WING BUCKLE

(71) Applicant: San Ragip Besbelli, San Pedro, CA (US)

(72) Inventor: San Ragip Besbelli, San Pedro, CA (US)

( * ) Notice: Subject to any disclaimer, the term of this patent is extended or adjusted under 35 U.S.C. 154(b) by 0 days.

(21) Appl. No.: 17/958,384

(22) Filed: Oct. 1, 2022

(51) Int. Cl.
*A44B 11/25* (2006.01)
*A44B 11/26* (2006.01)

(52) U.S. Cl.
CPC ..... *A44B 11/26* (2013.01); *A44B 11/2592* (2013.01)

(58) Field of Classification Search
CPC ..... A44B 11/26; A44B 11/2592
See application file for complete search history.

(56) References Cited

U.S. PATENT DOCUMENTS 3,639,948 A * 2/1972 Sherman ..... B64D 25/06 24/632
3,825,979 A * 7/1974 Jakob ..... A44B 11/2534 24/579.11
4,656,700 A * 4/1987 Tanaka ..... B64D 17/38 24/579.11
5,077,839 A * 1/1992 Keller ..... A44B 11/25 24/200
5,608,918 A * 3/1997 Salvaggio ..... A42B 3/085 24/169
5,791,026 A * 8/1998 Anscher ..... A44B 11/266 24/615
8,256,073 B2 * 9/2012 Zhang ..... A44B 11/266 297/483
8,448,308 B2 * 5/2013 Mountz ..... B60N 2/2812 24/615
8,468,660 B2 * 6/2013 Holler ..... A44B 11/2542 24/579.11
8,631,545 B2 * 1/2014 Ford ..... A44B 11/2569 24/632
9,521,895 B2 * 12/2016 Stuart ..... A45F 3/12
9,986,791 B2 * 6/2018 Botkus ..... A44B 11/2592
10,219,587 B1 * 3/2019 Chan ..... A44B 11/04
10,617,180 B1 * 4/2020 Yen ..... A44B 11/06
11,109,648 B1 * 9/2021 Crawford ..... A44B 11/2515
2008/0086853 A1 * 4/2008 Kolasa ..... A44B 11/266 24/616
2017/0079383 A1 * 3/2017 Huang ..... A44B 11/266
2021/0392999 A1 * 12/2021 Pontaoe ..... A44B 11/266
2022/0333668 A1 * 10/2022 Piao ..... F16G 11/101

* cited by examiner

*Primary Examiner* — Jason W San

(57) ABSTRACT

Ring and Wing Buckle is a new kind of fastener, which may be used to connect lose ends of belts, cords, wires, ropes, chains and the like in luggage, garment, fashion, jewelry, footwear, sports gear, construction, sailing, Recreation and similar fields of endeavor. It can be made in any size and of variety of materials like plastics, metals or wood, using flat, cut out slices layered together or as a solid body, using 3D printing, injection molding or casting. Flat and symmetrical body, allows multiple buckles to be layered together to form buckle hubs for harnesses.

5 Claims, 8 Drawing Sheets

4

5

6

RING AND WING BUCKLE

BACKGROUND OF THE INVENTION

Ring and Wing Buckle is a new kind of fastener, which may be used to connect lose ends of belts, cords, wires, ropes, chains and the like in luggage, garment, fashion, jewelry, footwear, sports gear, construction, sailing, Recreation and similar fields of endeavor.

BRIEF SUMMARY OF THE INVENTION

Ring and Wing Buckle's unique design allows it to be made from variety of materials such as Plastics, Metals, Wood and more. It may be constructed from thin layers of sheet materials, stacked up to form it's parts (FIG. 13) like plywood, sheet metal and the like as well as solid parts using 3D printing, injection molding, casting and the like.

Due to it's modular structure, multiple buckle unit's receiving parts can be stacked together by connecting through the assembly holes to form multi directional buckling hubs for harnesses where multiple lose ends of belts, cords, chains etc. can be connected. (FIG. 9,10)

Ring and Wing Buckle can be scaled and made in any size and it is symmetrical along A-A and 1-1 axes (FIG. 1), so that either face of the Ring (Receiving) and Wing (Inserting) parts may be engaged, and by attaching pull strings, it may be released from engaged position remotely (FIG. 12).

DETAILED DESCRIPTION OF THE INVENTION

Ring and Wing Buckle comprises 2 basic parts which are:

1—receiving part (Ring): receiving part of the buckle comprises a ring like body which has a slot(2) along the rim(1), which has 2 narrower slits(3) on both ends.

Directly across from the slot, there is a smaller alcove(5) and a attachment means(4) for items (e.g: belt, cord etc.) to be fastened.

2—inserting part (Wing): inserting part of the buckle comprises a shaft(6) and 2 articulated symmetrical wings(7), which pivot about an axis(10), and spring back by an embedded spring(9). Inserting part further comprises means(4) to attach items (e.g: belt, cord, rope etc.) to be fastened.

Figure 1:
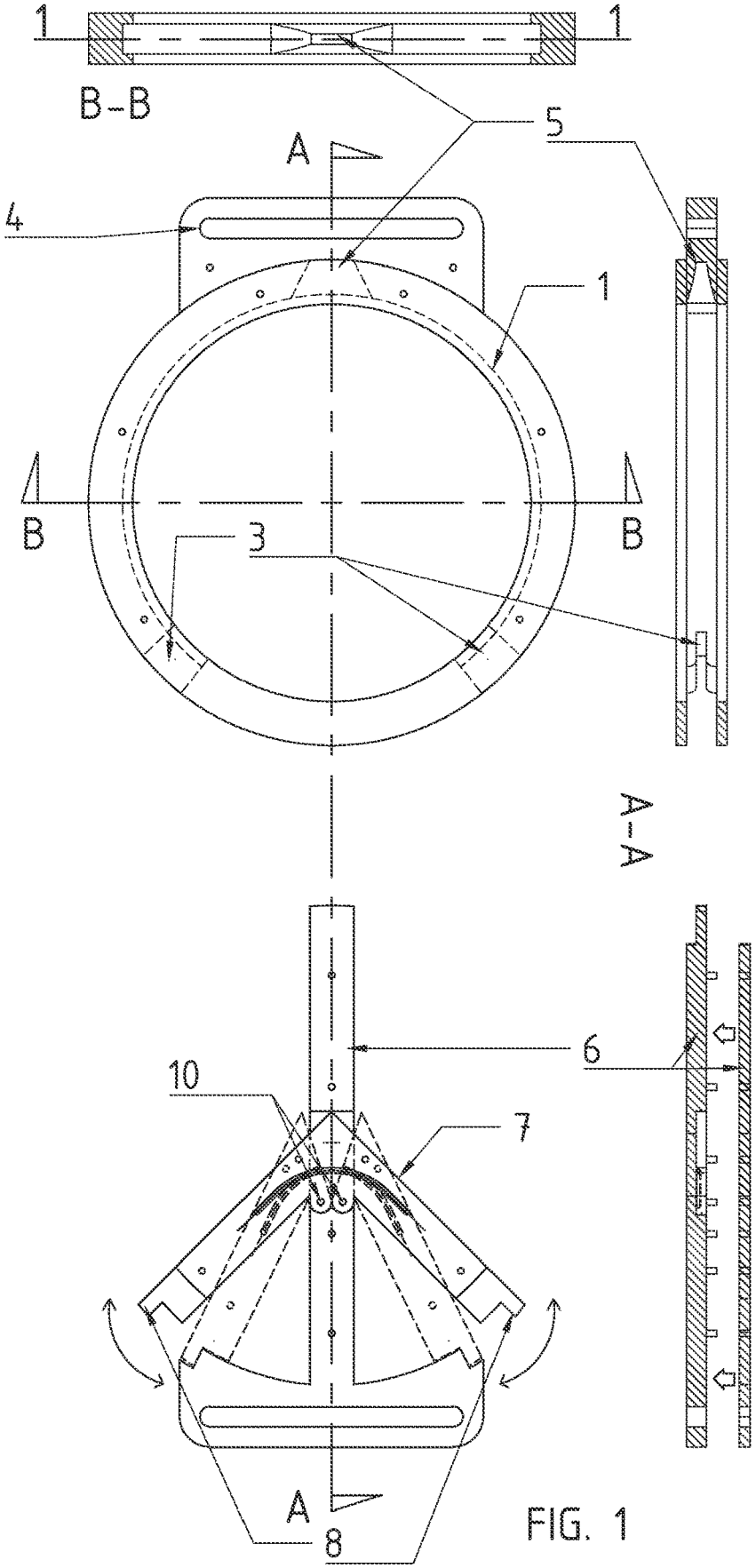
FIG. 1: Illustrating front and back views of the receiving part and the inserting part without top covering layer to show interior mechanism of the wing structure in parallel projection manner. In addition, 2 section views, and positions of the wings in flexed and neutral positions are illustrated.
Figure 2:
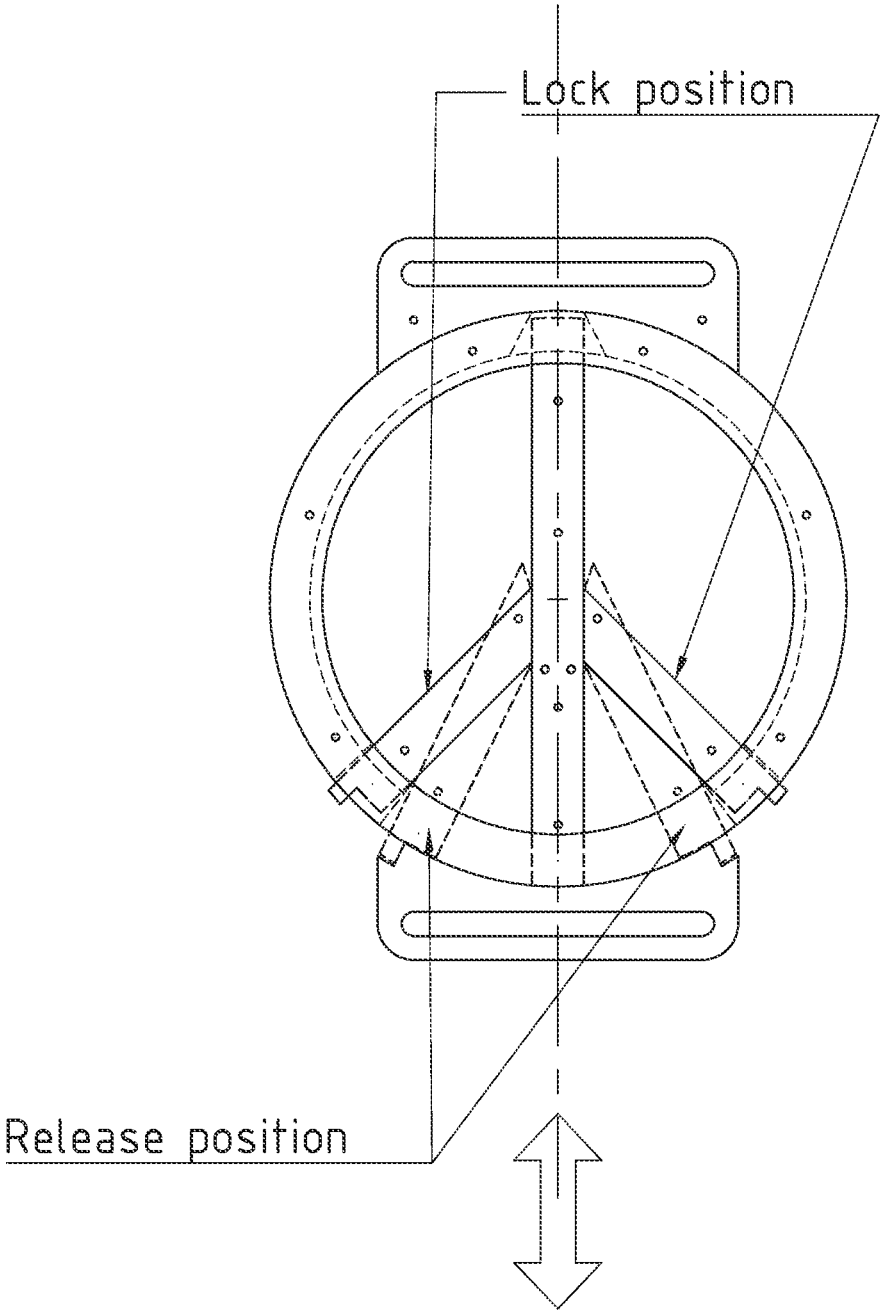
FIG. 2: Depicts buckle parts in engaged position, and further illustrates wings in locked or released positions.
Figure 3:
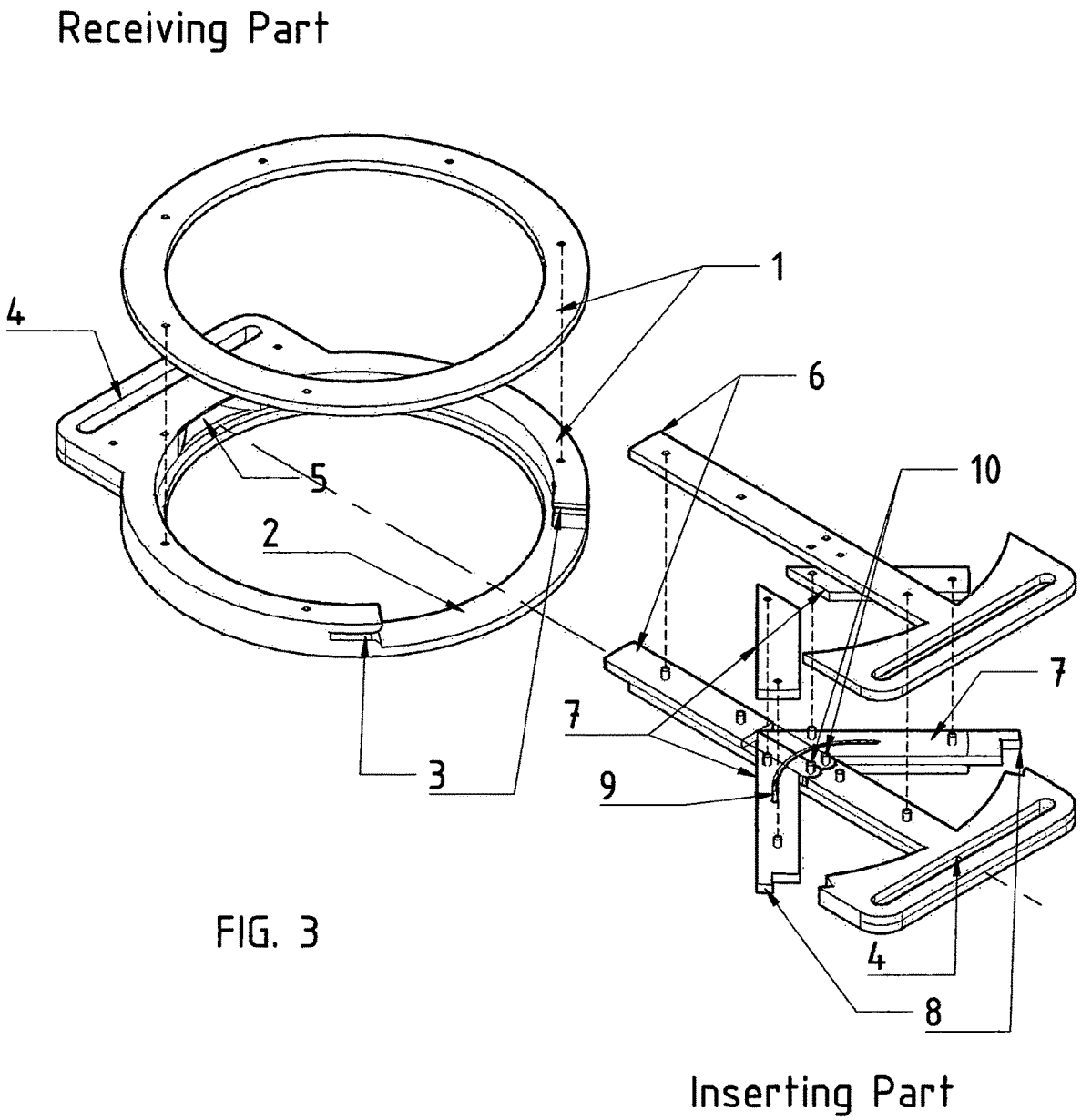
FIG. 3: Illustrating an exploded, axonometric view of the buckle parts to expose inner structure of the parts.
Figure 4:
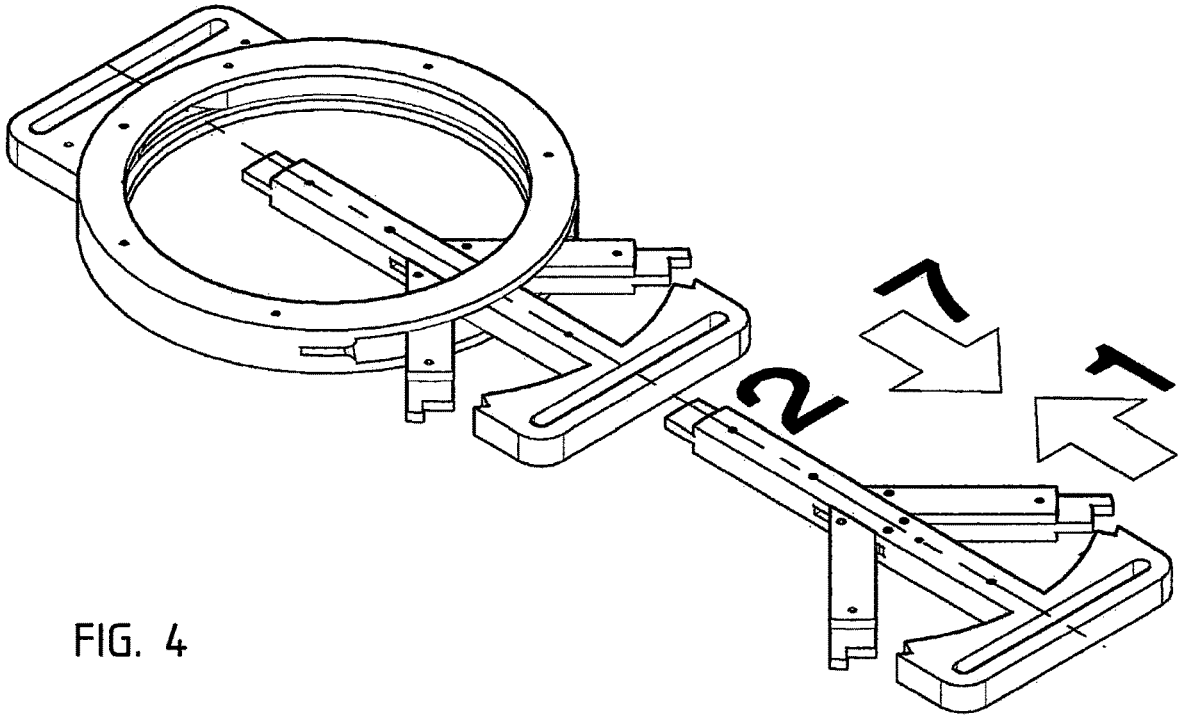
FIG. 4: Depicts the buckle parts in disengaged position 1 and insertion position 2 and releasing position 7.
Figure 5:
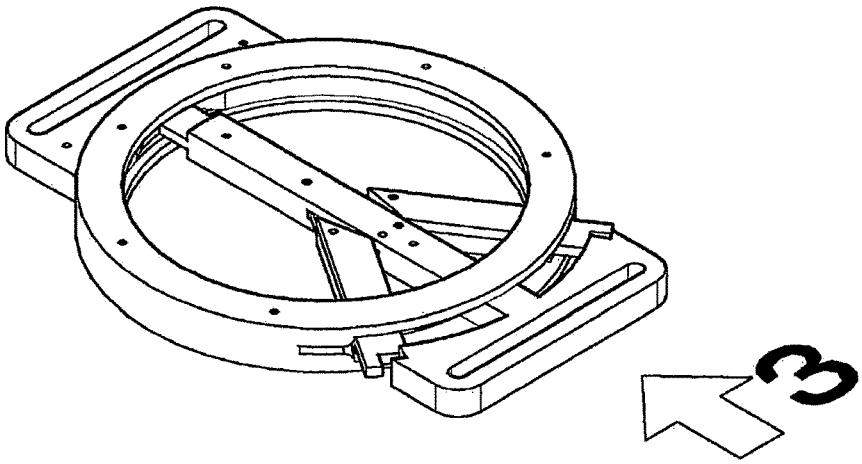
FIG. 5: Depicting insertion part going through the slot, where wings flex to allow passage.
Figure 6:
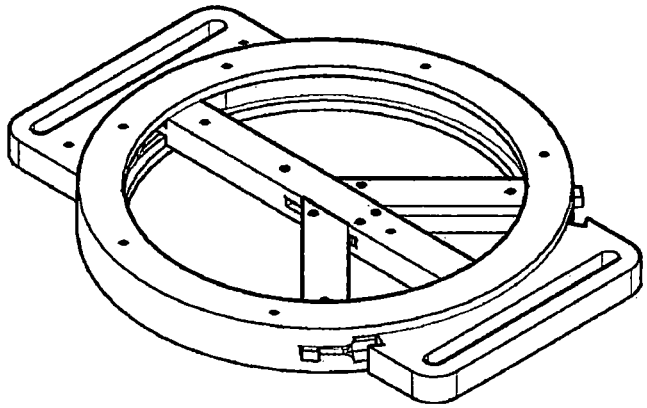
FIG. 6: Depicting the position 5, where inserting part is totally in lock position, where wings flexed back to neutral position thus locking the inserting part in place.

Ring and Wing Buckle operates by pushing the inserting part, through the slot(2) (FIG. 4), where 2 said wings(7) start to flex towards the stem(6) when they hit the outer edges of the slot(2) (FIG. 5), until thinner ends of both wings(8) slip into the slits(3) as wings flex outwards by the force of the spring(9), thus locking the inserting part into the receiving part (FIG. 6).

Figure 7:
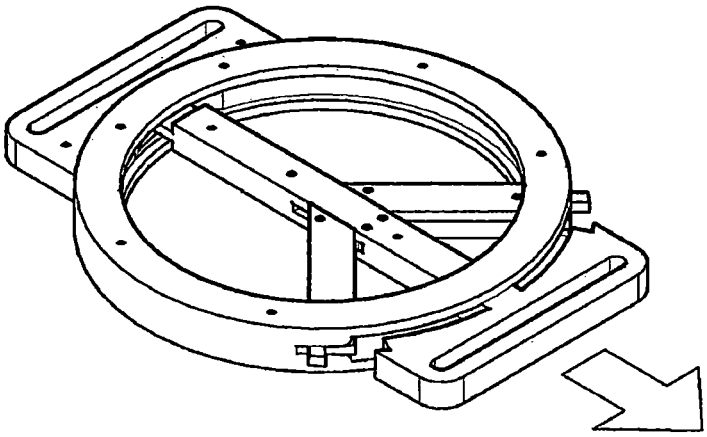
FIG. 7: Depicting the locked position 5, where wings are pressing on the rim of the receiving part to prevent parting the buckle.

When inserting part is pulled out of the slot(2)thicker ends of both wings lean against the rim wall(1) thus keeping the unit buckled (FIG. 7)

Figure 8:
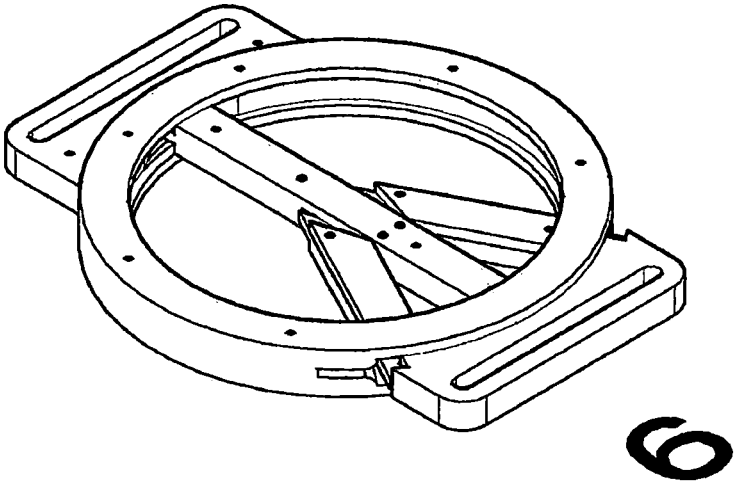
FIG. 8: Depicting the position 6, where wings are pressed together to clear the slot, prior to pulling out the inserting part as in position 7 as depicted in FIG. 1.
Figure 9:
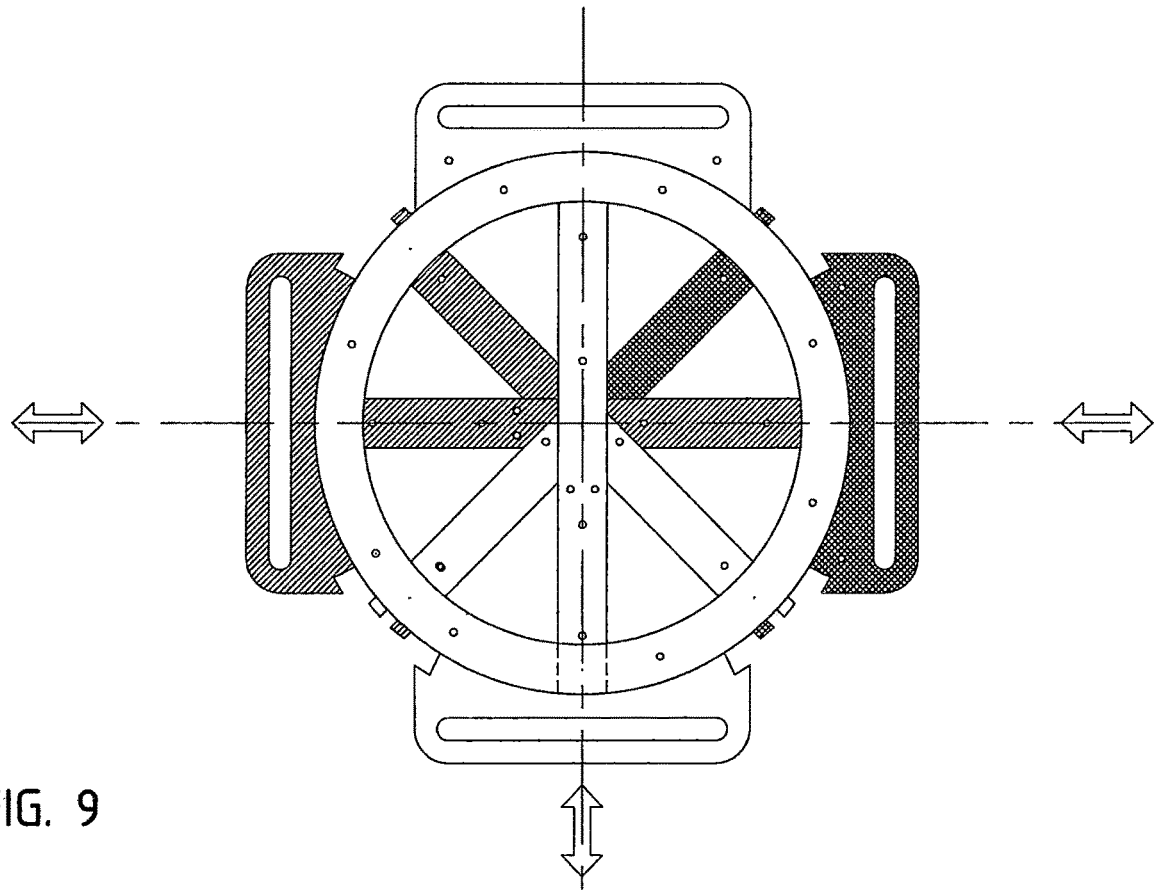
FIG. 9: Depicting top view, where 3 buckles are stacked up by bolting through the holes, in order to form an array of buckles which allows multiple connection points to form a harness.
Figure 10:
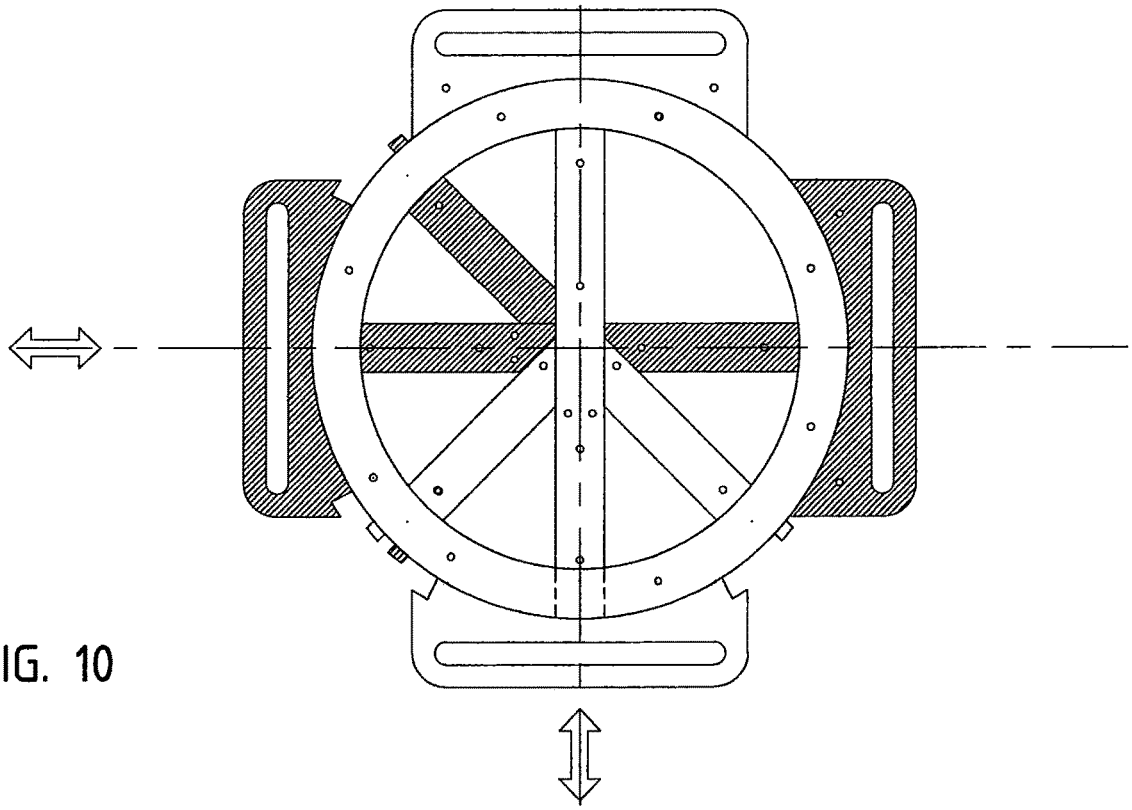
FIG. 10: Depicting top view, where 2 buckles are stacked up by bolting through the holes, in order to form an array of buckles which allows multiple connection points to form a harness.
Figure 11:
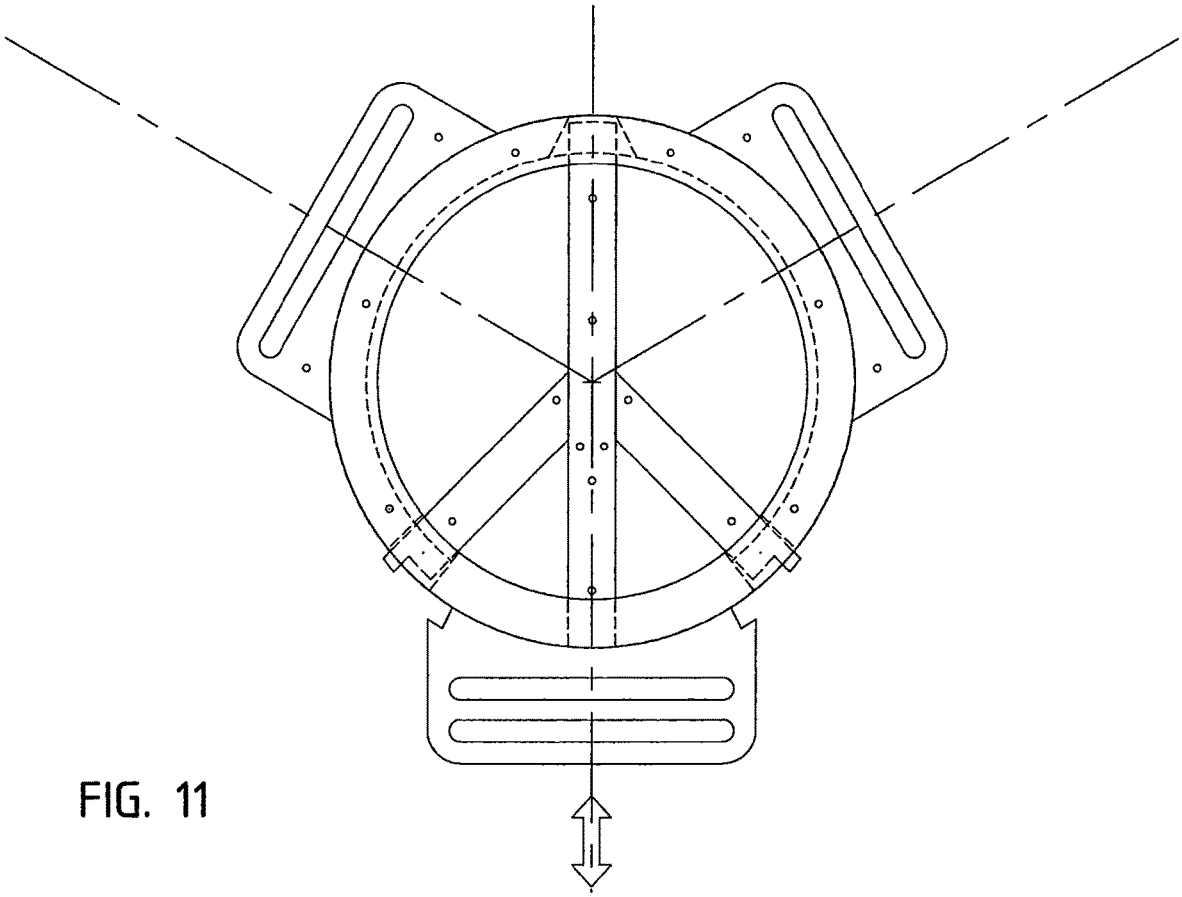
FIG. 11: Illustrating how multiple fixed connection points can be arranged around the ring shaped receiving body to form a multi point buckle.
Figure 12:
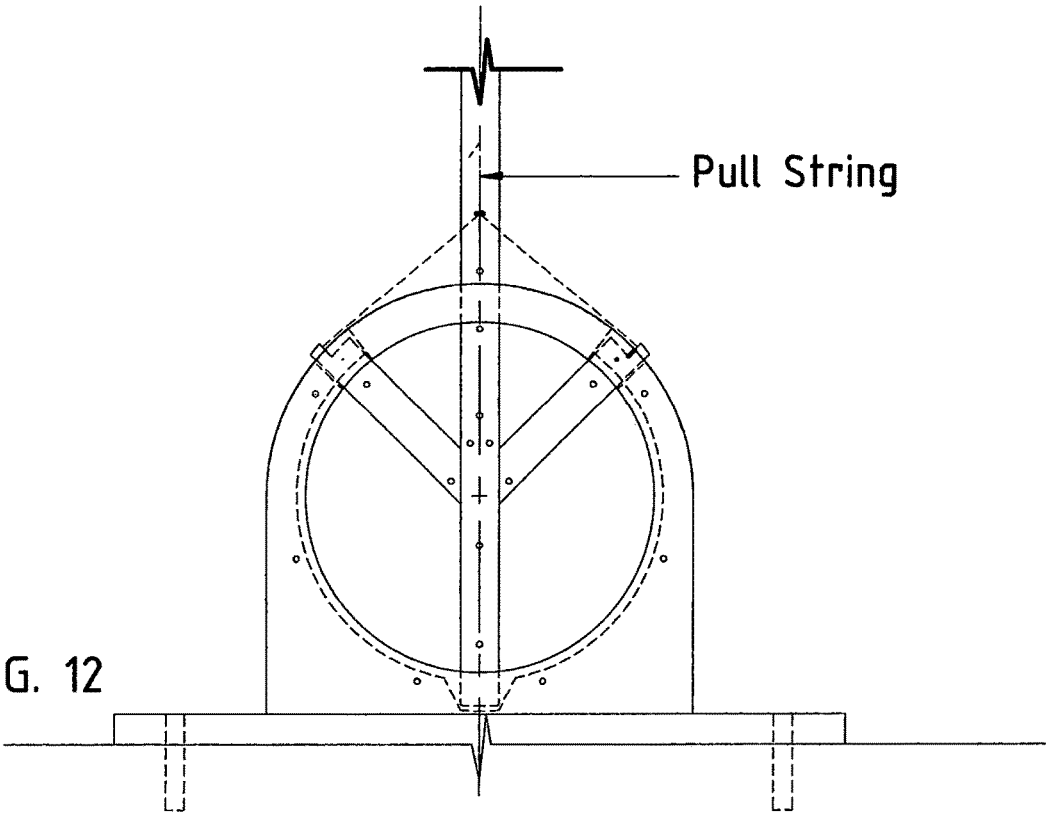
FIG. 12: Illustrating a possible application of the buckle system where middle stem extends to becomes a solid rod which allows remote insertion to fixed receiving part and can be remotely released by pull strings attached to the tips of the wings.
Figure 13:
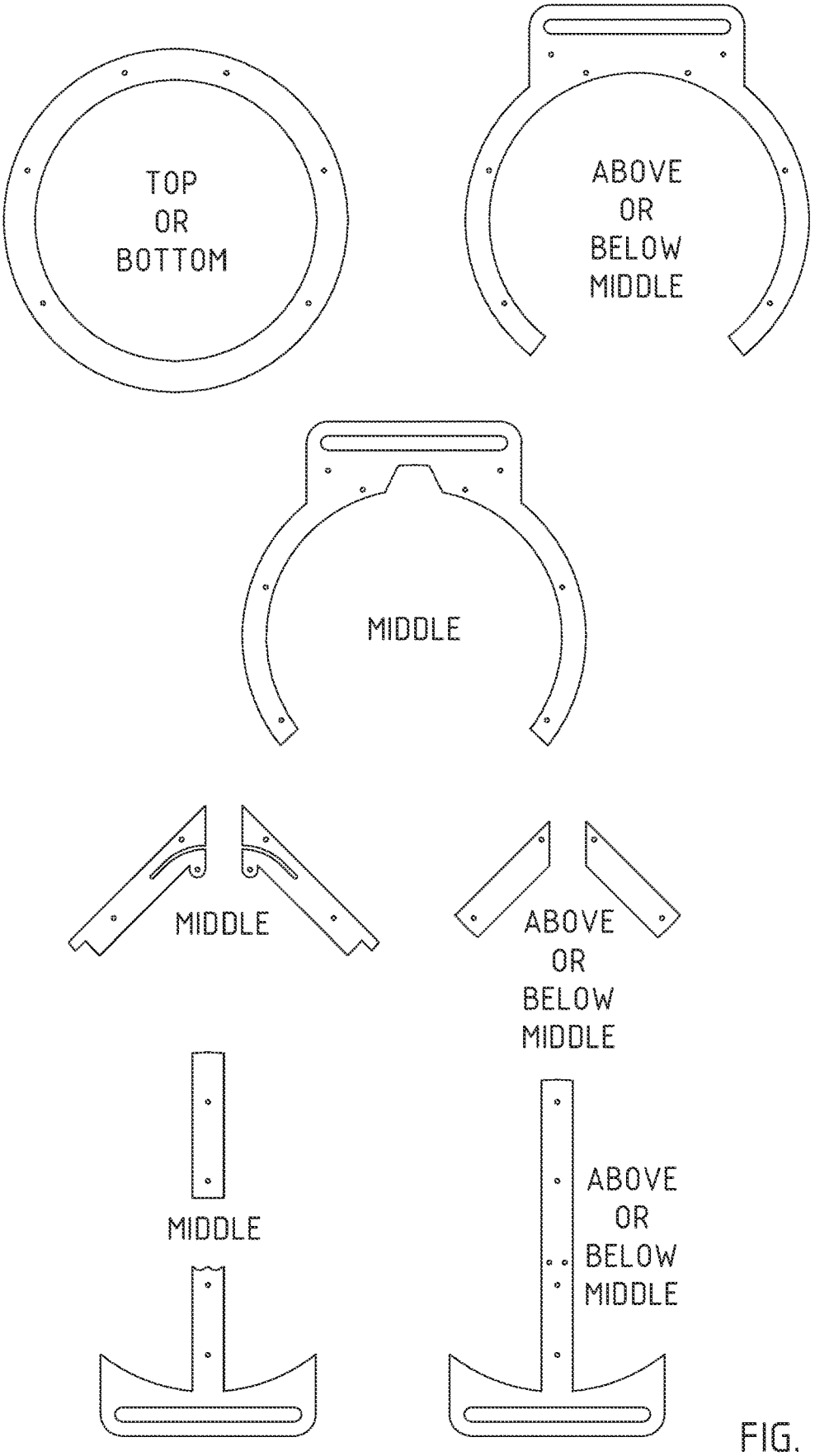
FIG. 13: Depicts outlines of constituent parts of the buckle system which can be cut out from sheet materials like sheet metal, sheet plastic or plywood, to be stacked up and connected as noted to form the buckle's receiving and inserting parts.

In order to release the buckle, tips of both wings(7) pressed towards the stem(6) by fingers (FIG. 8), and inserting part is pulled out when wings clear the slits(3) on both ends of the slot(2), whereby allowing inserting part to be pulled out of the receiving part (FIG. 4), thereby releasing the buckle.

The invention claimed is:

1. A buckle comprising:

a receiving part, with a ring-shaped form, comprising a slot along a rim of said receiving part, cutting through said rim, whereas said slot has an arcuate shape and comprises narrower slits on both ends of said slot, whereas said receiving part further comprises a cavity across said slot; and an inserting part, comprising a stem and two articulated wings, pivoting around axes in flexing fashion, allowing said wings to pivot towards said stem when pushed forward through said slot, just enough to pass through said slot along said rim of said receiving part, to flex back outwards upon clearing said slot on said rim of said receiving part, whereas narrower tips of said wings slip into said narrower slits at both ends of said slot on said rim, which receives a tip of said stem of said inserting part, into said cavity across said slot, locking said receiving and said inserting parts of the buckle, where thicker edges of said wings press against a body of said rim, preventing release of the buckle when pulled apart, and when said narrower tips of said wings are pressed together, said thicker edges of said wings clear said slits at both ends of said slot whereby allowing said inserting part to be pulled out of said slot, releasing the buckle.

2. The buckle as in claim 1, whereas a plurality of said receiving parts comprise assembly holes configured to be connected to form array of receiving bodies, which then can receive a plurality of said inserting parts, and wherein said rims of said receiving parts are aligned with each other.

3. The buckle as in claim 1, wherein said narrower slits and said slot are integrated into a single space such that said wings can switch between a released position and a locked position when said tip of said stem of said inserting part is inserted into said cavity of said receiving part.

4. The buckle as in claim 1, wherein an end opposite to said narrow tip of said wing is pivotally attached to a central position of said stem and is embedded in said stem.

5. The buckle as in claim 1, wherein said inserting part further comprises a spring embedded in said swings and located at a central position of said stem.

* * * * *